US006821324B2

(12) United States Patent
Shacham-Diamand et al.

(10) Patent No.: US 6,821,324 B2
(45) Date of Patent: Nov. 23, 2004

(54) COBALT TUNGSTEN PHOSPHORUS ELECTROLESS DEPOSITION PROCESS AND MATERIALS

(75) Inventors: Yosi Shacham-Diamand, Zichron-Yaakov (IL); Yelena Sverdlov, Netanya (IL)

(73) Assignee: Ramot At Tel-Aviv University Ltd., Tel Aviv (IL)

( * ) Notice: Subject to any disclaimer, the term of this patent is extended or adjusted under 35 U.S.C. 154(b) by 0 days.

(21) Appl. No.: 10/176,142

(22) Filed: Jun. 19, 2002

(65) Prior Publication Data

US 2003/0235658 A1 Dec. 25, 2003

(51) Int. Cl.[7] ..... C23C 18/00; C23C 18/50; C23C 18/54

(52) U.S. Cl. ..... 106/1.22; 106/1.27; 205/126; 205/187; 427/443.1

(58) Field of Search ..... 427/443–1, 436; 106/1.12, 1.22, 1.27; 205/126, 187

(56) References Cited

U.S. PATENT DOCUMENTS

| | | | | |
|---|---|---|---|---|
| 4,231,813 A | | 11/1980 | Carlin | 148/6.3 |
| 5,695,810 A | | 12/1997 | Dubin et al. | 427/96 |
| 6,127,282 A | * | 10/2000 | Lopatin | 438/754 |
| 6,165,912 A | * | 12/2000 | McConnell et al. | 438/758 |
| 2001/0019892 A1 | * | 9/2001 | Komai et al. | 438/687 |
| 2002/0036143 A1 | * | 3/2002 | Segawa et al. | 205/187 |
| 2002/0081842 A1 | * | 6/2002 | Sambucetti et al. | 438/678 |
| 2002/0123220 A1 | * | 9/2002 | Sambucetti et al. | 438/678 |

FOREIGN PATENT DOCUMENTS

| | | | |
|---|---|---|---|
| EP | 1 001 054 | 5/2000 | C25D/3/60 |

OTHER PUBLICATIONS

Shi–Quing Wang, MRS Bull., XVIX (8), p. 30, 1994, no month.

C–A, Chang and C–K, Hu, Appl. Phys. Lett., 57, p. 617, Aug. 1990.

E. Blanquet, A.M. Dutron, V. Ghetta, C. Bernard and R. Madar, Microel Eng., 37–38, p. 189, 1997, no month.

J.O. Olowolafe, C.J. Mogab, R.B. Gregory, and M. Kottke, J. Appl. Phys., 72, p. 4099, Nov. 1992.

C.S. Choi, G.A. Ruggles, A.S. Shah, G.C. Xing, C.M. Osburn, and J.D. Hunn, J. Electrochem Soc., 138, p. 3062, Oct. 1991.

E.J. O'Sullivan, A.G. Schrott, M. Paunovic, C.J. Sambucetti, J.R. Marino, P.J. Bailey, S. Kaja, and K.W. Semkov, IBM J. Res. Develop., 42, p. 607, Sep. 1998.

M. Paunovic, P.J. Bailey, R.G. Schad and D.A. Smith, J. Electrochem. Soc., 141, 1843, Jul. 1994.

S. Lopatin, Y. Shacham–Diamand, V. Dubin, P.K. Vasudev, in: Proceedings of 191st Meeting of the Elctrochemical Society, Montreal, Symp. F1, Canada, 1997, no month.

(List continued on next page.)

*Primary Examiner*—Michael LaVilla
(74) *Attorney, Agent, or Firm*—Darby & Darby

(57) ABSTRACT

Materials and methods are described for electroless deposition of cobalt phosphorus and cobalt tungsten phosphorus, employing tungsten trioxide or tungsten phosphoric acid as a source of tungsten.

Electolessly deposited metals produced are substantially devoid of alkali metal ions and alkaline earth metal ions. The deposits are typically oxygen-free thin films having a low sheet resistivity of less than 50 $\mu\Omega$.cm.

The films may be used as capping layers or barriers for the prevention of interlayer metallic drift, diffusion and migration in semiconductor, ULSI, VLSI, electroplating industries and products.

21 Claims, 12 Drawing Sheets

OTHER PUBLICATIONS

A. Kohn, M. Eizenberg, Y. Shacham–Diamand, B. Israel and Y. Sverdlov, Microel Eng., 55, p. 297, 2001a, no month.

A. Kohn, M. Eizenberg, Y. Shacham–Diamand, Y. Sverdlov, Mater. Sci. Eng. A, 302, 18, 2001b, no month.

Y. Shacham–Diamand, Y. Sverdlov, Microel. Eng., 50, p. 525, 2000, no month.

Chiu H. Ting and M. Paunovic, J. Electrochem. Soc., 136, p. 456, Feb. 1989.

Physico–Chemical Origins of the Chemical Reduction of Cobalt, K.M. Gordunova ed., Science Publishing, Moscow 1974, (in Russian), no month.

Y. Shacham–Diamand, Y. Sverdlov and N. Petrov, J. Electrochem. Soc., 148, C162, 2001, no month.

V. Sviridov, "Electroless Deposition of Metals", University of Publication, Minsk, 1987, no month.

* cited by examiner

COBALT TUNGSTEN PHOSPHORUS ELECTROLESS DEPOSITION PROCESS AND MATERIALS

FIELD OF THE INVENTION

The present invention relates generally to metallic deposition materials and processes, and more specifically to materials and processes for metallic electroless deposition.

BACKGROUND OF THE INVENTION

Metallic diffusion and/or drift between different metallic layers, or metallic and semiconductor layers induce changes over time in the properties of the layer into which diffusion and/or drift has occurred. These properties include electrical, mechanical, thermal, visual, physical and chemical properties. There is great importance to many industries to produce products having both constant properties over time and high reliability. These industries include, but are not limited to semiconductor, microelectronics, electro-finishing, aeronautic, space and motor industries. Products requiring high reliability include, for example, semiconductor chips, ULSI products, jewelry, nuts and bolts, and airplane wings and car parts. Typically, the smaller the product, the more pronounced an effect of a localized change in a property of a layer.

In the semiconductor industry, the diffusion of metals into adjacent layers is well documented. For example, copper diffuses into silicon materials. To prevent such diffusion, a barrier layer between the copper and silicon may be deposited (U.S. Pat. No. 5,695,810 to Dubin et al.)

The microelectronics industry constantly aims to reduce the size of components and the distance between interconnects, yet, simultaneously, tries to increase the number of electronic features per unit area. Thus, there is an increasing requirement for more accurate and well-controlled metal deposition techniques. For example, with decreasing size of copper/$SiO_2$ interconnects, standard processes known in the art for metal deposition cannot typically meet the new requirements for precision. There is therefore an urgent need for better designed processes, materials and manufacturing methods for metal deposition.

One of the concerns in manufacturing and processing copper, amongst other metals, is its corrosion, before and after Chemical-Mechanical Polishing (CMP), which may induce deterioration in the electrical and mechanical properties of the copper. Another concern is the migration of copper onto the inter-level dielectric and the silicon substrate. Copper contamination in inter-level dielectrics weakens the dielectrics' mechanical properties and reduces electrical reliability. Copper is also a deep level dopant in silicon, which may lower the minority carriers lifetime and may enhance leakage currents to significant levels.

Copper has poor adhesion to most dielectrics that are used in ULSI manufacturing, such as, but not limited to, $SiO_2$, SiOF, polyimide and low-K dielectrics. Therefore, the implementation of a copper encapsulation method is desirable. One possible solution is to wrap the Cu lines with special thin metallic cladding that serves as a. a corrosion resistance layer; b. a diffusion barrier; and c. adhesion promoter.

There are many materials that are known to be good barrier diffusion. Usually they are refractory metals, such as Ta, W and Mo, or refractory metal nitride thin films such as TiN, TaN, and $W_xN_y$. The layers can be deposited by conventional physical vapor deposition (PVD), chemical vapor deposition (CVD) or Atomic Layer Chemical Vapor Deposition (ALCVD).

Alternative methods for barriers are electroplating and electroless (autocatalytic) deposition of Co- or Ni-based alloys. For example, it was shown that 100 nm thick electroless Co—P functions as barrier against Cu diffusion at temperatures of up to 400° C. Addition of a refractory metal (e.g. W, Mo, or Re) ion to Co—P alloy improves its barrier properties significantly and 30 nm $Co_{88}W_2P_{10}$ holds against copper diffusion at temperatures up to 500° C.

Commonly used solutions for wet deposition of cobalt and nickel thin films contain alkali metal ions such as sodium or potassium. For example, conventional bath compositions for electroless deposition of Co(P,W) and Ni(P,W) layers include tri-sodium citrate as complexing agent, sodium tungstate as a source for W, sodium hypophosphite as a reducing agent, and sodium or potassium hydroxides to adjust the pH of the solution.

Alkali metal ions have many negative effects on the performance of CMOS integrated circuits. Sodium and potassium ions migrate rapidly under electric field in inter-level oxide, field oxide and gate oxide. The alkali metal ions degrade the dielectric strength of $SiO_2$ by increasing leakage current and decreasing breakdown field. The effect of alkali metal ions is also very pronounced in transistor technologies that their characteristics depend on the electric field at the Si/$SiO_2$ interface. Since alkali metal ions are very mobile in $SiO_2$ the effective charge's position in the silicon dioxide may vary under the applied electric field at normal circuit operation. This shift in the charge distribution centroid affects the internal electric field distribution and may causes long-term instabilities.

There is therefore an urgent need to develop novel materials and methods for metallic deposition which overcome the diffusion, drift and migration of metallic ions, in particular, alkali metal ions, between layers.

SUMMARY OF THE INVENTION

It is an object of some aspects of the present invention to provide improved materials and processes for providing a barrier layer for metallic layers, such as copper.

In preferred embodiments of the present invention, improved materials and processes are provided for the electroless deposition of cobalt tungsten phosphorus, substantially devoid of alkali metal ions and alkaline earth metal ions.

In other preferred embodiments of the present invention, methods and materials for activating a non-metallic surface for electroless deposition thereupon of cobalt tungsten phosphorus, substantially devoid of alkali metal ions and alkaline earth metal ions, are provided.

In further preferred embodiments of the present invention, methods and materials for activating a metallic surface for electroless deposition thereupon of cobalt tungsten phosphorus, substantially in the absence of alkali metal ions and alkaline earth metal ions, are provided.

In further preferred embodiments of the present invention, methods and materials for electroless deposition of cobalt tungsten phosphorus, substantially devoid of alkali metal ions and alkaline earth metal ions, on a single silicon crystal, on a thermal oxide on silicon, and on thin films of copper and cobalt on silicon substrates are provided.

In yet further preferred embodiments of the present invention metallic deposits of cobalt phosphorus and cobalt tungsten phosphorus are provided, wherein the deposits are substantially alkali metal free, alkaline earth metal free and oxygen free.

In still further preferred embodiments of the present invention, metallic thin films of cobalt phosphorus and cobalt tungsten phosphorus are provided, wherein the films are substantially alkali metal free, alkaline earth metal free and oxygen free.

There is thus provided in accordance with a preferred embodiment of the present invention, an aqueous composition for the electroless deposition of cobalt tungsten phosphorus, including;

at least one cobalt ion;

at least one tungsten containing ion; and a reducing agent comprising at least one phosphorus atom; and, wherein the composition is substantially devoid of alkali metal ions and alkaline earth metal ions.

In a preferred embodiment of the invention, the at least one cobalt ion is provided by cobalt sulfate heptahydrate ($CoSC_4.7H_2O$). Preferably, the cobalt sulfate septahydrate ($CoSO_4.7H_2O$) is present at a concentration of 10–25 g/l. Yet more preferably, the cobalt sulfate septahydrate ($CoSO_4.7H_2O$) is present at a concentration of 15–18 g/l. In another preferred embodiment of the invention, the cobalt ion is provided in the form of cobalt chloride hexahydrate ($CoCl_2.6H_2O$) in a concentration of 10–40 g/l.

In a preferred embodiment, the at least one tungsten containing ion is provided by at least one of the group of tungsten trioxide ($WO_3$) and tungsten-phosphoric acid ($H_3[P(W_3O_{10})]_4$).

Preferably, the tungsten trioxide ($WO_3$) is present at a concentration of 0–7 g/l. Preferably, the tungsten-phosphoric acid ($H_3[P(W_3O_{10})]_4$) is present at a concentration of 0–60 g/l, alone or together with $WO_3$.

Preferably, the reducing agent is selected from ammonium hypophosphoric acid ($NH_4H_2PO_2$) and hypophosphoric acid ($H_3PO_2$). Preferably, the ammonium hypophosphoric acid ($NH_4H_2PO_2$) is present at a concentration of 10–30 g/l, more preferably, the ammonium hypophosphoric acid ($NH_4H_2PO_2$) is present at a concentration of 12–25 g/l, and most preferably, the ammonium hypophosphoric acid ($NH_4H_2PO_2$) is present at a concentration of 15–20 g/l.

In a preferred embodiment of the invention, the composition further comprises a complexing agent. Preferably, the complexing agent includes triammonium citrate ($[NH_4)_3C_6H_4O_7$). More preferably, the triammonium citrate is present at a concentration of 40–60 g/l.

In a further preferred embodiment, the composition further includes a surfactant. Preferably, the surfactant includes at least one of RE-610 and Triton X-100.

In a preferred embodiment of the present invention, a cobalt tungsten phosphorus film is deposited on a surface from a bath comprising any of the aforementioned bath compositions. Preferably, the film has a thickness of less than approximately one micron. More preferably, the film thickness is less than approximately 0.1 micron.

In a preferred embodiment of the present invention, the film has a resistivity of less than 100 microOhm.cm. More preferably, the resistivity of said film is less than 50 microOhm.cm.

In another preferred embodiment of the present invention, the film comprises 0–12% phosphorus.

In a further preferred embodiment of the present invention, the film comprises 0–6% tungsten.

In yet another preferred embodiment of the present invention, the film comprises at least 85% cobalt.

In a still further preferred embodiment of the present invention, the film acts as a diffusion barrier for a metal on the surface, wherein the metal is selected from copper, gold, platinum, palladium, silver, nickel, cadmium, indium and aluminum.

Preferably, the film is substantially free of alkali earth metals and alkali metals.

Preferably, the film is substantially oxygen-free. Preferably, the film acts as an oxidation barrier. Additionally or alternatively the film acts as a corrosion barrier.

There is also provided in accordance with another preferred embodiment of the present invention, a method for the electroless deposition of cobalt tungsten phosphorus on a surface, including;

electrolessly depositing cobalt tungsten phosphorus on the surface, substantially in the absence of alkali metal ions and alkaline earth metal ions.

In a preferred embodiment of the present invention, the method further comprises activating the surface, and wherein activating the surface occurs at least partially under dry process conditions. Preferably, the surface comprises silicon. Additionally or alternatively, the surface comprises cobalt. Additionally or alternatively, the surface comprises copper.

In a further embodiment, activating the surface further comprises depositing at least one metal on the surface. Preferably, the at least one metal is selected from aluminum, cobalt, copper and titanium.

In a further preferred embodiment, the method further comprises removing at least partially some of the at least one metal.

In yet another preferred embodiment of the present invention, activating the surface occurs, at least partially, under wet process conditions.

In a preferred embodiment of the present invention, activating the surface comprises at least one of the following steps;

(a) degreasing the surface;

(b) removing at least one oxide from the surface;

(c) fluoride etching the surface;

(d) rinsing the surface;

(e) activating the surface with palladium; and (f) pre-dipping the surface in a solution comprising at least one of a reducing agent and a complexing agent.

Preferably, the surface includes at least one of silicon, cobalt and copper.

In a further preferred embodiment, the method includes depositing a film of the cobalt tungsten phosphorus on the surface. Preferably, the thickness of the film is less than approximately one micron, and more preferably the film thickness is less than approximately 0.1 micron.

In a preferred embodiment of the present invention, the film has a resistivity of less than 100 microOhm.cm. More preferably, the resistivity is less than 50 microOhm.cm.

In a preferred embodiment of the present invention, the method provides a film including 0–12 % phosphorus.

In another preferred embodiment of the present invention, the method provides a film including 1–6% tungsten.

In yet another preferred embodiment of the present invention, the method provides a film including at least 85% cobalt.

In still another preferred embodiment of the present invention, the method includes depositing the cobalt tungsten phosphorus at a temperature of around 70° C. up to 100° C. More preferably, the temperature is at least 80° C.

In yet another preferred embodiment of the present invention, the method includes depositing the tungsten phosphorus at a pH of around 8 up to about 12. More preferably, the pH is from around 9 up to about 11.

The present invention will be more fully understood from the following detailed description of the preferred embodiments thereof, taken together with the drawings, in which:

DETAILED DESCRIPTION OF PREFERRED EMBODIMENTS

Novel bath compositions for electroless deposition of cobalt phosphorus and cobalt tungsten phosphorus were prepared as in Table 1. In contrast to the prior art bath compositions, these bath compositions were substantially devoid of alkali metal ions and alkaline earth metal ions.

Furthermore, two new sources of tungsten ions were employed, namely, tungsten trioxide ($WO_3$) and tungsten phosphoric acid ($H_3[P(W_3O_{10})_4]$).

TABLE 1

QUALITATIVE COMPOSITIONS FOR ELECTROLESS DEPOSITION OF COBALT PHOSPHORUS AND COBALT TUNGSTEN PHOSPHORUS

| | Chemicals | | |
|---|---|---|---|
| Function | Solution Co-4A | Solution Co-4C | Solution Co-4M |
| Source of Co ions | $CoSO_4.7H_2O$ | $CoSO_4.7H_2O$ | $CoSO_4.7H_2O$ |
| Complexing agent | Tri-ammonium-citrate | Tri-ammonium-citrate | Tri-ammonium-citrate |
| Reducing agent | $H_3PO_2$ (50% solution) | $H_3PO_2$ (50% solution) | $NH_4H_2PO_2$ |
| Source of tungsten | $WO_3$ | $H_3[P(W_3O_{10})_4]$ | $WO_3$ |
| Surfactant | RE-610 (Nonylphenol Ethoxylate, Chemtec) | | |

Typical bath compositions for the electroless deposition of cobalt phosphorus and cobalt tungsten phosphorus are shown in Table 2 hereinbelow. These bath compositions were employed at temperatures above 80 ° C., and more typically 85–95° C. at atmospheric pressure.

TABLE 2

Typical Bath Compositions for the Electroless Deposition of Cobalt Phosphorus and Cobalt Tungsten Phosphorus (alkali metal free solutions)

| Chemicals | Concentration |
|---|---|
| $COSO_4.7H_2O$ | 15–17 gr/l (0.0534–0.0612 mole/l) |
| $NH_4H_2PO_2$ | 15–18 gr/l (0.181–0.217 mole/l) |
| Tri-ammonium citrate | 47–53 gr/l (0.208–0.234 mole/l) |
| $WO_3$ | 0–7 gr/l (0–0.0302 mole/l) |

TABLE 2-continued

Typical Bath Compositions for the Electroless Deposition of Cobalt Phosphorus and Cobalt Tungsten Phosphorus (alkali metal free solutions)

| Chemicals | Concentration |
|---|---|
| $(NH_4)_2SO_4$ | 30–32 GR/L (0.227–0.242 MOLE/L) |
| TMAH | to pH = 10–10.5 |
| RE-610 | 0.04 gr/l |

The bath compositions prepared preferably contain cobalt sulfate as a source for cobalt ions. The source of cobalt ions could also be cobalt chloride hexahydrate, for example.

Typically, tri-ammonium citrate was used as the complexing agent. Two different reducing agents were used in the study: a. ammonium hypophosphite and b. hypophosphoric acid. All chemicals were of analytical grade.

The working pH value of 10–10.7 was maintained by using a buffering system of ammonium sulfate and tetramethylammonium hydroxide.

Figure 11:
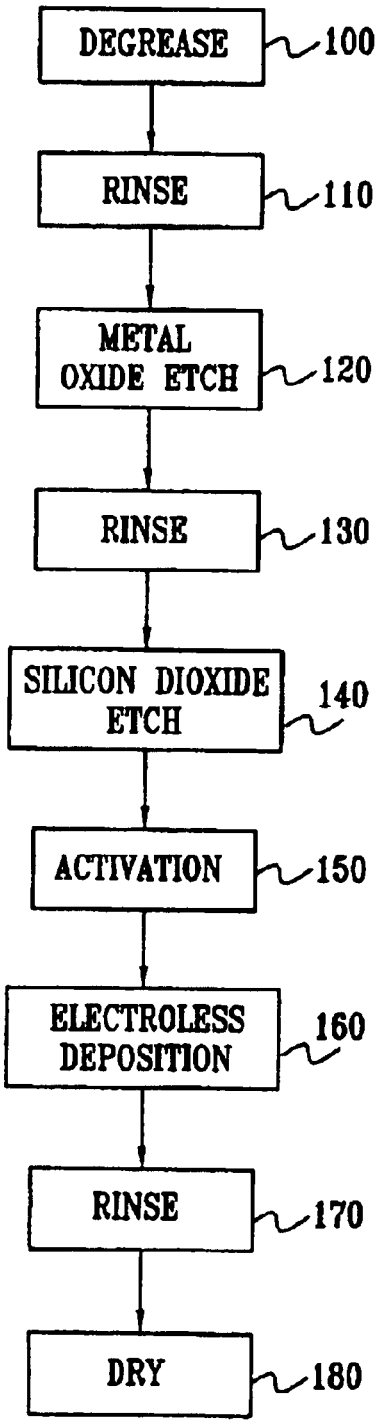
FIG. 11 is a simplified flow chart of a typical production process for the electroless deposition of cobalt tungsten phosphorus, including an activation stage, in accordance with a preferred embodiment of the present invention.
Figure 12:
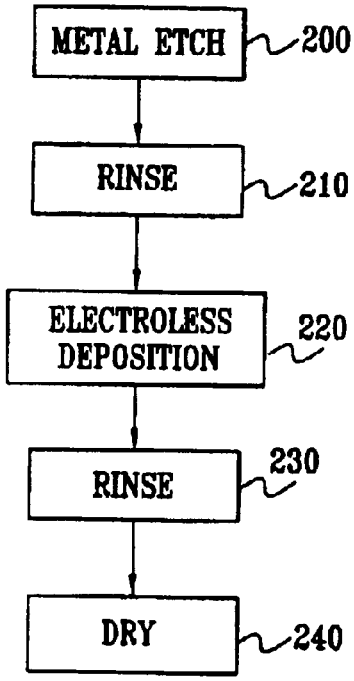
FIG. 12 is a simplified flow chart of a typical production process for the electroless deposition of cobalt tungsten phosphorus, excluding an activation stage, in accordance with a preferred embodiment of the present invention.

Both metallic and non-metallic substrate surfaces were prepared for electroless deposition as is described in further detail hereinbelow (FIGS. 11–12). Typically, cobalt phosphorus and cobalt tungsten phosphorus layers obtained by electroless deposition had a thickness of 100–600 nm.

Figure 1:
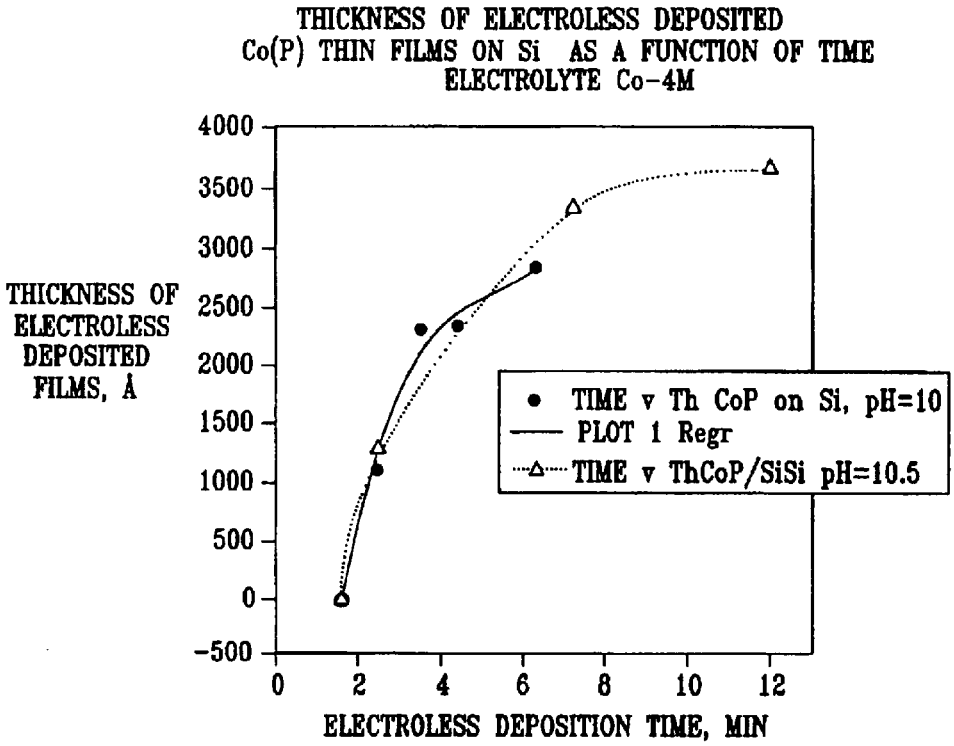
FIG. 1 is a diagram showing the thickness of cobalt phosphorus Co(P) films as a function of time, deposited electrolessly from a bath composition, substantially free of alkali metal ions, at a pH of 10 and of 10.5 on a silicon substrate, in accordance with a preferred embodiment of the present invention.

Reference is now made to FIG. 1, which is a diagram showing the thickness of cobalt phosphorus Co(P) films as a function of time, from bath composition Co-4C (Table 1) at a) a pH of 10 and b) a pH of 10.5 on a palladium-activated silicon substrate. It can be seen in FIG. 1, that there was no lag time before deposition of cobalt phosphorus occurred on the silicon layer. Initial deposition was rapid (around 1000 Å/min) both at pH 10 and 10.5. The deposition rate declined thereafter at both pH 10 and 10.5, indicating that some factor in the bath or on the surface was limiting the deposition rate.

Figure 2:
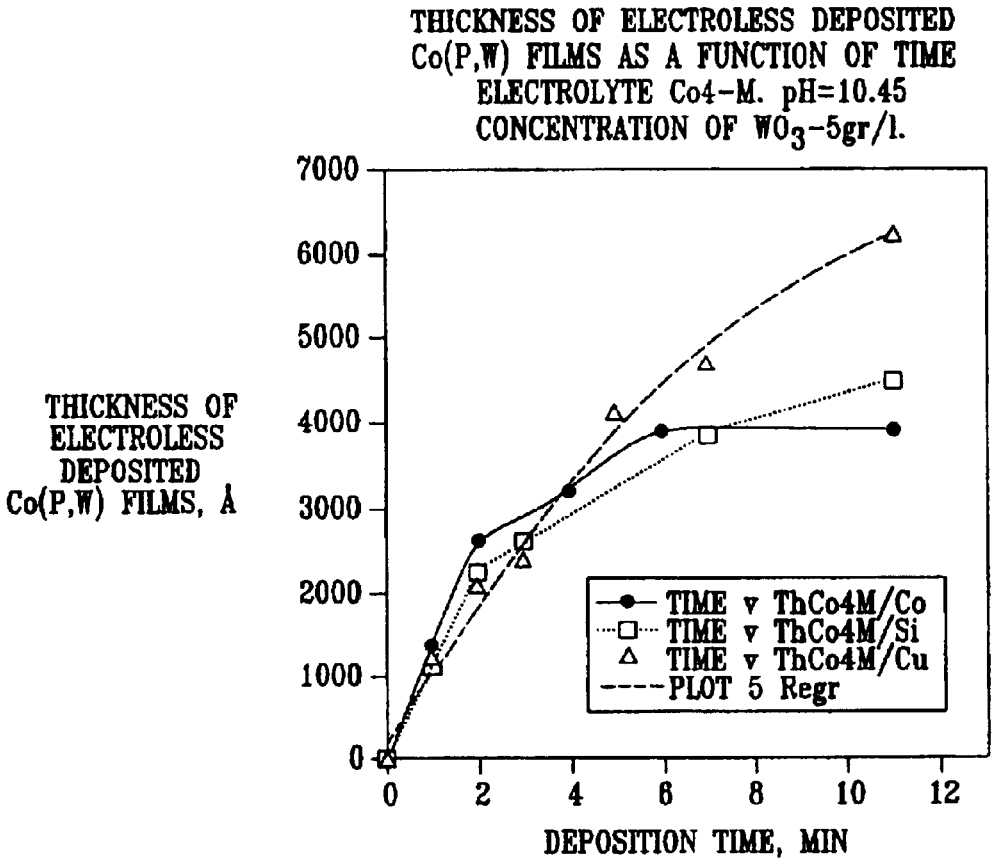
FIG. 2 is a diagram showing the thickness of electrolessly deposited cobalt tungsten phosphorus Co(W,P) films from a bath composition, substantially devoid of alkali metal ions, at a pH of 10.5 on different underlayers, in accordance with a preferred embodiment of the present invention.

Reference is now made to FIG. 2, which is a diagram showing the thickness of electrolessly deposited cobalt tungsten phosphorus Co(W,P) films from a bath composition, at a pH of 10.5 on different underlayers.

The data shown in FIG. 2 represent the kinetics of electroless film deposition on three different substrates: a) sputtered copper; b) sputtered cobalt; and c) palladium-activated silicon. The bath conditions for these depositions included tungsten in the form of 0.022 M $WO_3$ at pH value was 10.5–10.7.

As can be seen from FIG. 2, no significant lag time was observed before the deposition of cobalt tungsten phosphorus began. This held true both for metallic (copper or cobalt) and non metallic surfaces (silicon). The initial deposition rate was 1000–1500 Å/min for all types of surface employed.

It was further observed that the Co(W,P) deposits on a silicon substrate could not been obtained at pH=10. In contrast, Co(W,P) layers were deposited at a working pH value to 10.5–10.7. From the FIG. 2 it can be seen that in first 4 minutes of deposition process the rate of the film growth on cobalt, copper and Si was close for all three substrates. After 4 minutes of deposition, the thickness of the film increased more rapidly on copper seed than on the other two substrates. Thus, the thickness of the deposited films on copper seed after 11 minutes of deposition was about 600 nm. The thickness of the deposited on silicon substrate and cobalt seed films after the same time was about 400 nm.

All three bath compositions, shown in Table 1, produced high quality films; i.e. bright, uniform and with low defect density. All the layers contained Co, P and W at various concentrations. The layers that were obtained from bath composition Co-4M had the highest W content as compared to those obtained from the other two bath compositions. The Co-4M solution was more stable than the other two, which tended to age quite rapidly. The composition of the solution was varied within the designated ranges (Table 2).

Figure 3:
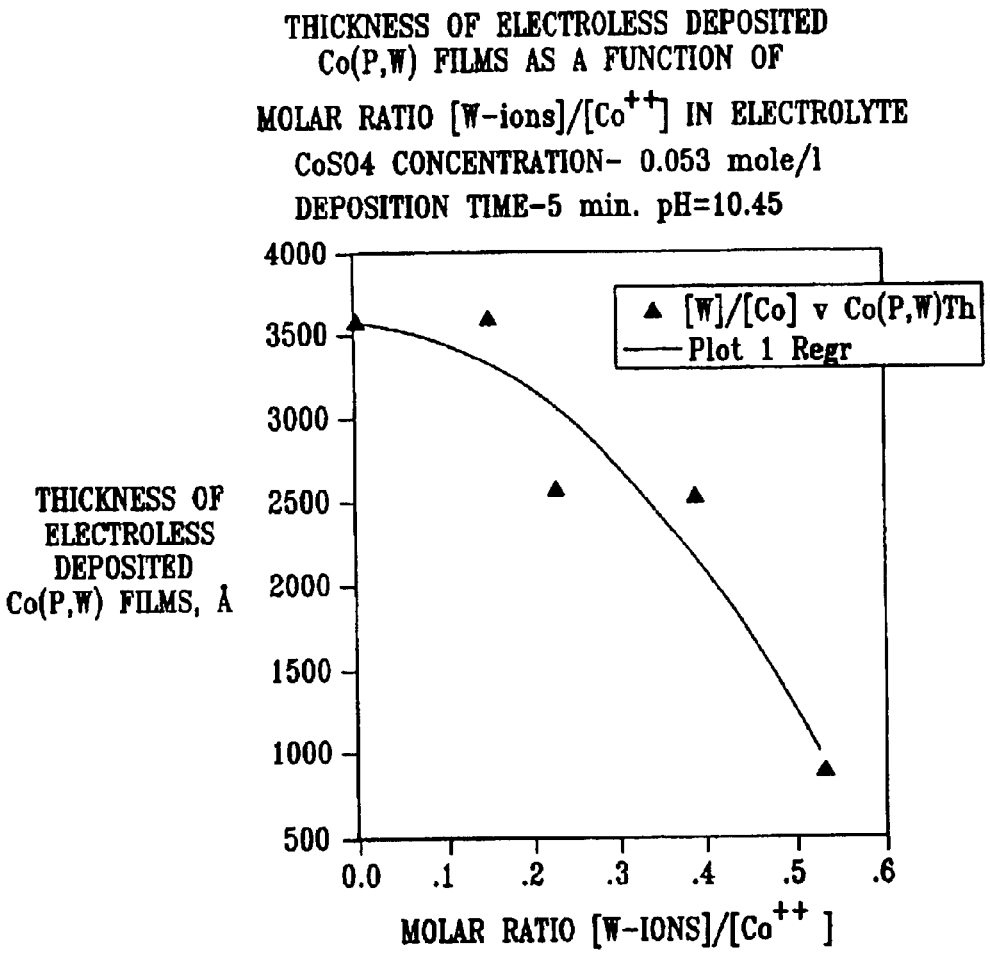
FIG. 3 is a diagram showing the effect of a ratio of the concentration of tungsten/cobalt ions [W]/[Co] on the thickness of deposited films, in accordance with a preferred embodiment of the present invention.

Reference is now made to FIG. 3, which is a diagram showing the effect of a ratio of the concentration of tungsten/cobalt ions [W]/[Co] on the thickness of deposited films.

FIG. 3 demonstrates an effect of tungsten trioxide concentration in the bath on the thickness of the deposited films. As it can be seen from FIG. 3, the thickness of the deposit is constant when the tungsten trioxide $WO_3$ concentration is varied from 0 to 0.0087 mol/l. An addition of the tungsten trioxide into the solution (zero up to 0.032 mol/l) causes decrease in the thickness of the electroless deposited films.

The composition of the electroless deposited Co (W,P) films was determined by using XPS and AES techniques. The results of the measurements are shown in FIG. 4 and presented in Table 3 hereinbelow.

The electroless Co(P,W) films were prepared by controlling the concentration of tungsten source in the bath. The concentrations of tungsten trioxide ($WO_3$) were—0, 0.0087, 0.013, 0.022 and 0.0302 mol/l, while the concentration of cobalt ions was fixed at 0.057 mol/l. The concentration of tungsten in the deposited metal depends on the concentration of tungsten trioxide in the bath composition. An increase in the concentration of tungsten trioxide in the bath results in an increase the content of tungsten in electrolessly deposited layers. This effect is demonstrated in FIG. 4.

Figure 4:
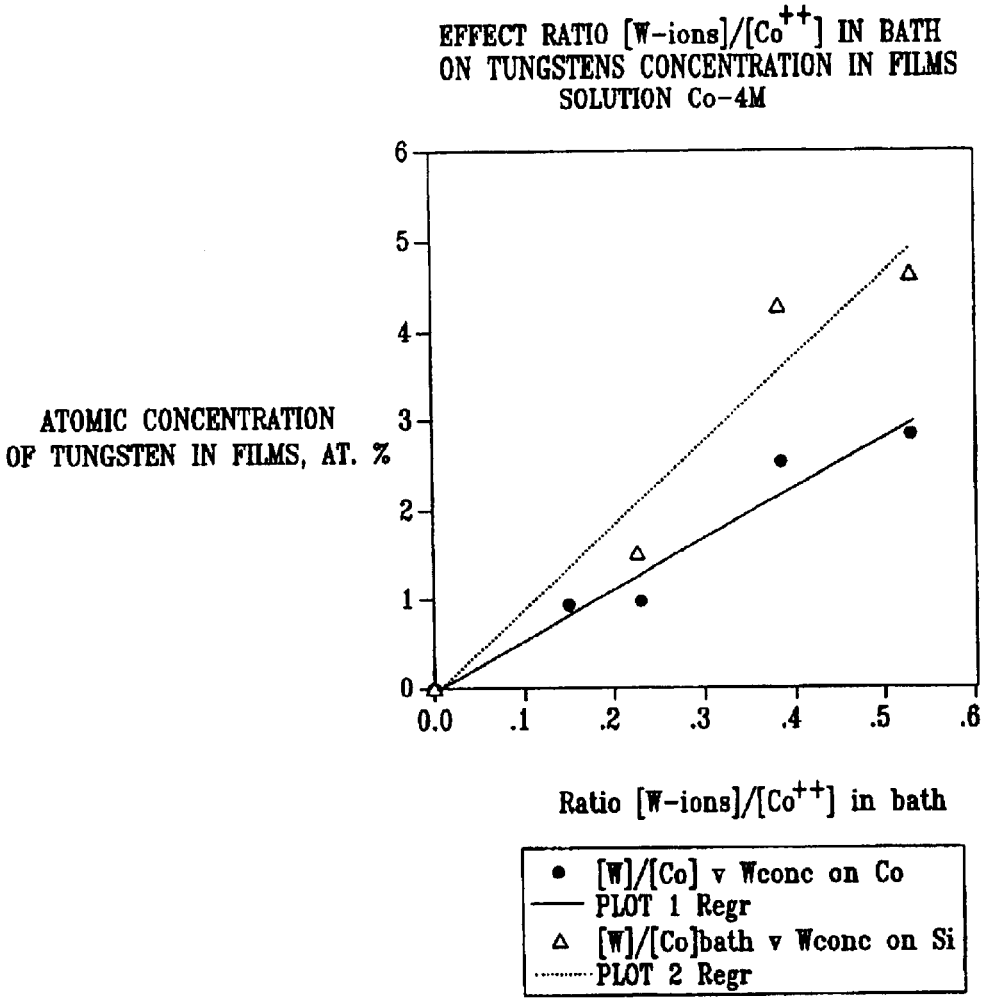
FIG. 4 is a diagram of the concentration of tungsten in a deposited film as a function of the ratio of tungsten to cobalt ion [W]/[Co] of the bath composition, in accordance with a preferred embodiment of the present invention.

Turning to FIG. 4 and Table 3, it can be seen that the concentration of tungsten in a deposited film is a function of the ratio of tungsten to cobalt ion [W]/[Co] of the bath composition.

TABLE 3

Co, W and P Atomic Concentration in Metallic Films obtained from bath composition designated "Co-4M".

| P, at. % | W, at. % | Ca, at. % | O, at. % |
|---|---|---|---|
| 3.35 | 1.97 | 94.63 | 0 |
| 3.54 | 2.15 | 94.31 | 0 |
| 3.32 | 4.28 | 92.41 | 0 |
| 3.10 | 4.64 | 92.27 | 0 |

It can be seen from Table 3, that films deposited from the alkali free bath composition Co(P,W) did not contain oxygen. The phosphorus concentration is maintained at a nearly constant value. Cobalt concentration decreases with increasing tungsten concentration in the solid.

Figure 5A:
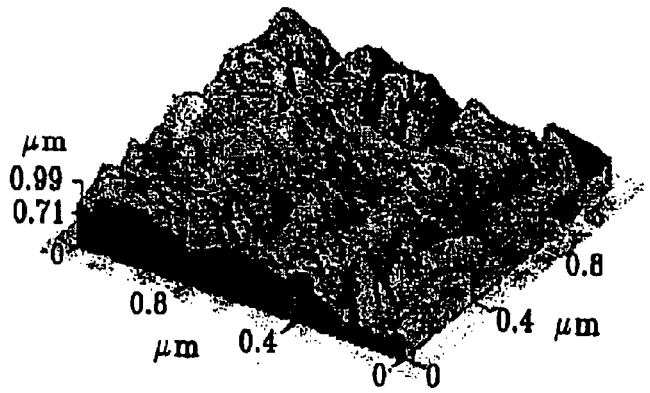
FIG. 5A is an atomic force microscopic (AFM) image of a Co(P,W) film deposited from a bath composition substantially devoid of alkali metal ions, on palladium-activated silicon in accordance with a preferred embodiment of the present invention.
Figure 5B:
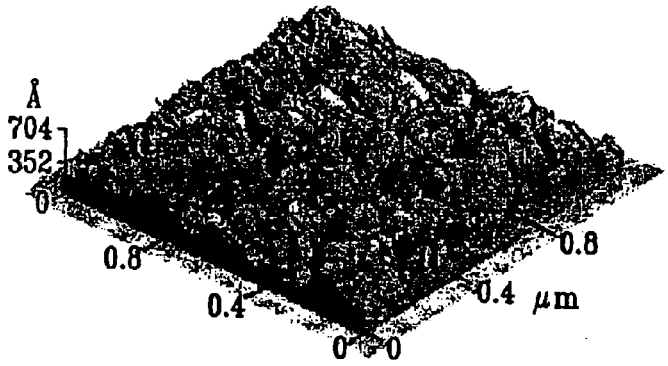
FIG. 5B is an atomic force microscopic (AFM) image of a Co(P,W) film deposited from a bath composition substantially devoid of alkali metal ions, on a copper seed layer on silicon dioxide in accordance with a preferred embodiment of the present invention.
Figure 5C:
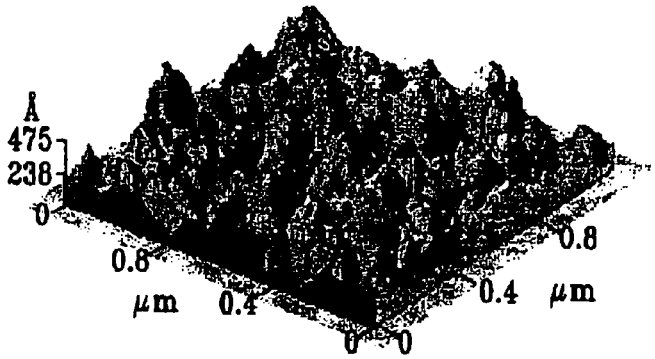
FIG. 5C is an atomic force microscopic (AFM) image of a cobalt tungsten phosphorus Co(P,W) film, deposited from a bath composition substantially devoid of alkali metal ions, on a cobalt seed layer on silicon, in accordance with a preferred embodiment of the present invention.

Reference is now made to FIG. 5A, which is an atomic force microscopic (AFM) image of a Co(P,W) film deposited from a bath composition substantially devoid of alkali metal ions, on palladium—activated silicon. FIG. 5B is an atomic force microscopic (AFM) image of a Co(P,W) film deposited from a bath composition substantially devoid of alkali metal ions, on a copper seed layer on silicon dioxide. For comparison with FIGS. 5A and 5B, FIG. 5C is an atomic force microscopic (AFM) image of a cobalt tungsten phosphorus Co(P,W) film, deposited from a bath composition substantially devoid of alkali metal ions, on a cobalt seed layer on silicon.

The texture of electroless Co(W,P) deposited from alkali metal ion free solution "Co-4M" films on different substrates (Cu and Co seed layers and on palladium activated silicon) was observed employing AFM and SEM. AFM scans of the metallic layers deposited respectively on a palladium-activated silicon (FIG. 5A), on a cobalt seed layer (FIG. 5B) and on a copper seed layer (FIG. 5C) were compared. It is seen that surface morphology of the deposit strongly depends on that of the substrate material. The deposit on copper seed has much finer texture than that on cobalt seed or on palladium-activated silicon. The deposit on cobalt seed seemed to produce a texture with separated nodules. The deposit on silicon consists of large, uniform nodules close packed on the surface. This may be, in some way, indicative of a limiting factor in the deposition on cobalt and silicon, as observed in FIG. 2.

Figure 6A:
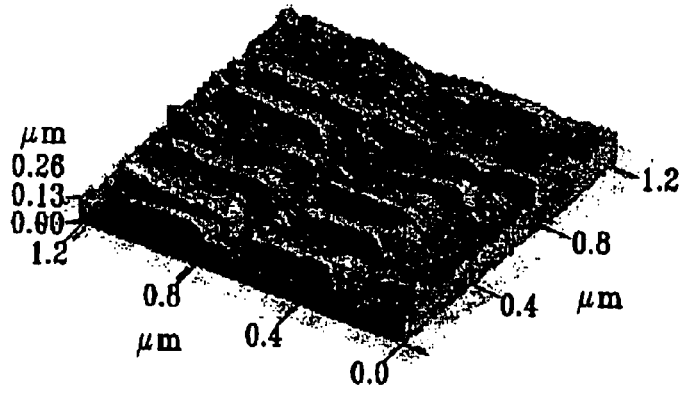
FIGS. 6A–6C are AFM images of palladium-activated silicon, cobalt and copper underlayers;.
Figure 6B:
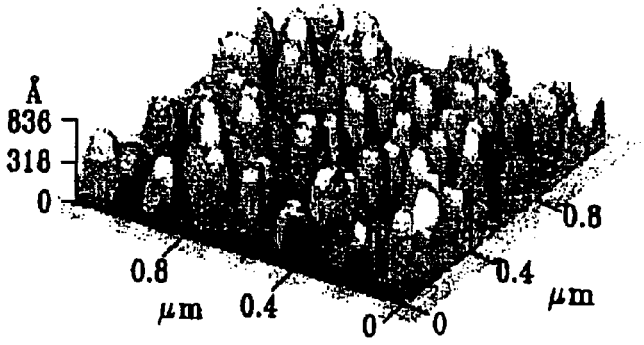
Figure 6C:
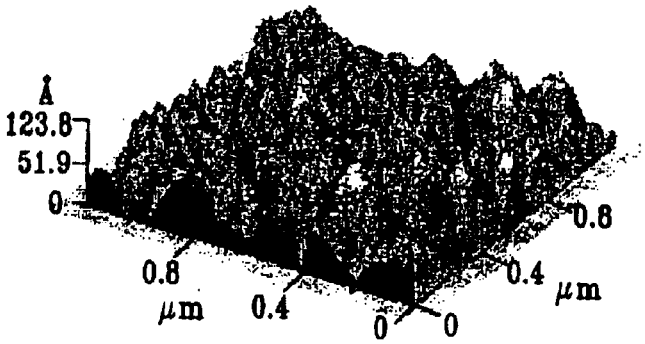

FIGS. 6A–6C are AFM images of palladium-activated silicon, cobalt and copper underlayers. These figures are used for comparison, demonstrating surface morphology of the different underlayers that were implemented, prior to electroless deposition.

Figure 7:
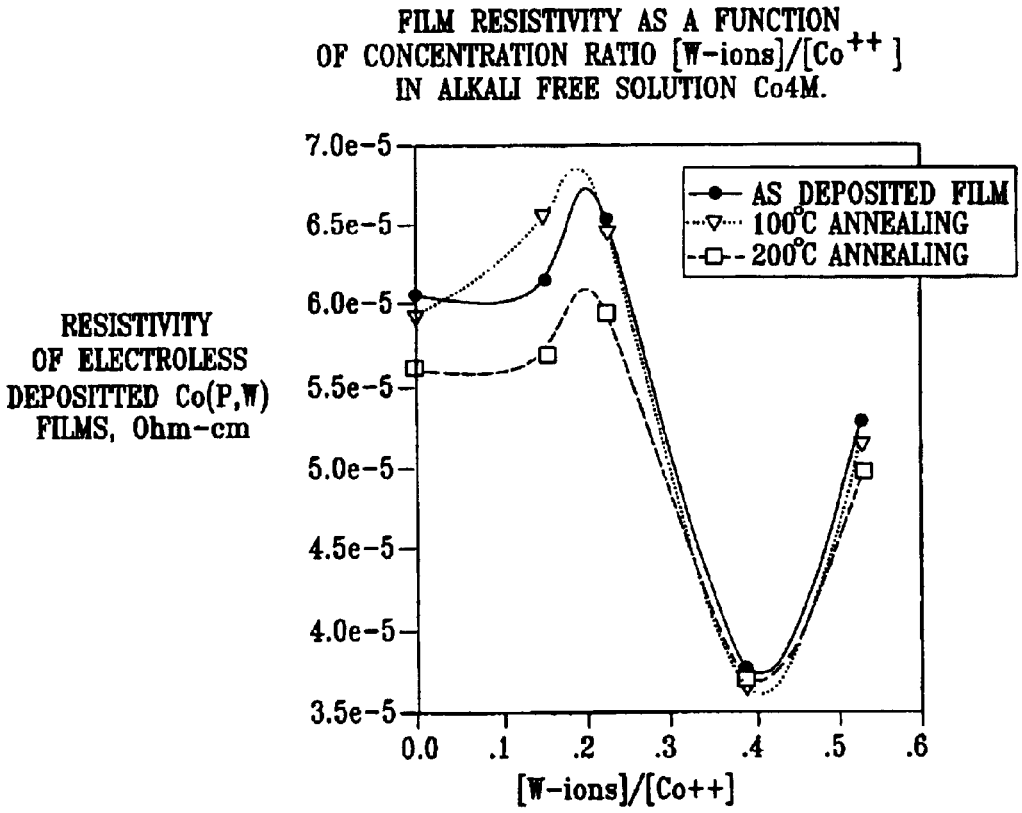
FIG. 7 is a diagram showing the effect of the ratio of tungsten/cobalt [W]/[Co] in a bath composition substantially devoid of alkali metal ions, on the resistivity of cobalt tungsten phosphorus films deposited therefrom, in accordance with a preferred embodiment of the present invention.

Reference is now made to FIG. 7, which is a diagram showing the effect of the ratio of tungsten/cobalt [W]/[Co] in a bath composition substantially devoid of alkali metal ions, on the resistivity of cobalt tungsten phosphorus films deposited therefrom. It can be seen from this figure that the resistivity is less than 65 microOhm.cm, and a minimum value of the resistivity appears when the ratio of tungsten-:cobalt ions is equal to approximately 4.

Figure 8A:
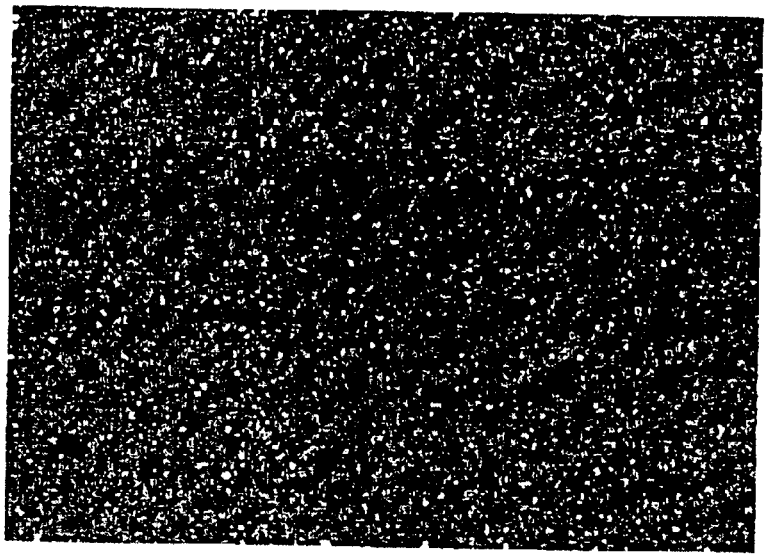
FIG. 8A is a scanning electron microscope (SEM) image of cobalt tungsten phosphorus Co(W,P) layers deposited from a bath composition substantially devoid of alkali metal ions on a cobalt seed, at a resolution of 10,000, in accordance with a preferred embodiment of the present invention.
Figure 8B:
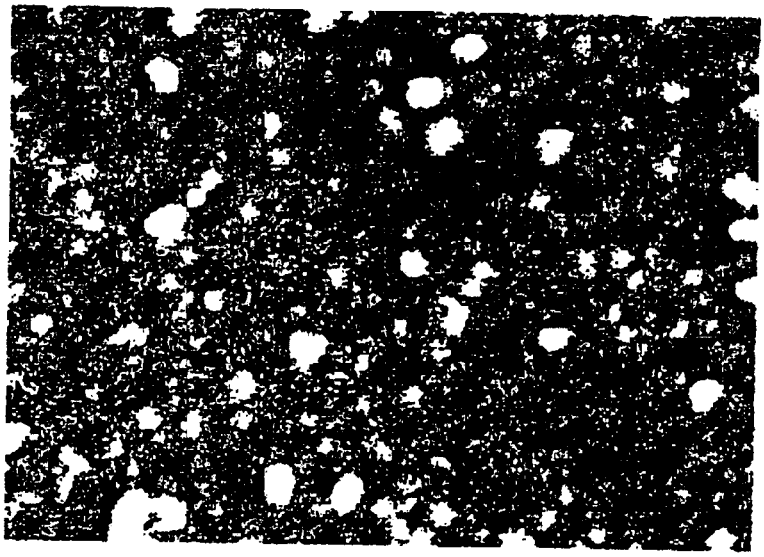
FIG. 8B is a scanning electron microscope (SEM) image of a cobalt tungsten phosphorus Co(W,P) layer deposited from a bath composition substantially devoid of alkali metal ions on a cobalt seed, at a resolution of 50,000, in accordance with a preferred embodiment of the present invention.

Reference is now made to FIG. 8A, which is a scanning electron microscope (SEM) image of cobalt tungsten phosphorus Co(W,P) layers deposited from a bath composition substantially devoid of alkali metal ions on a cobalt seed, at a resolution of 10,000. The same layers viewed at a greater resolution (50,000) appear in FIG. 8B.

Figure 9A:
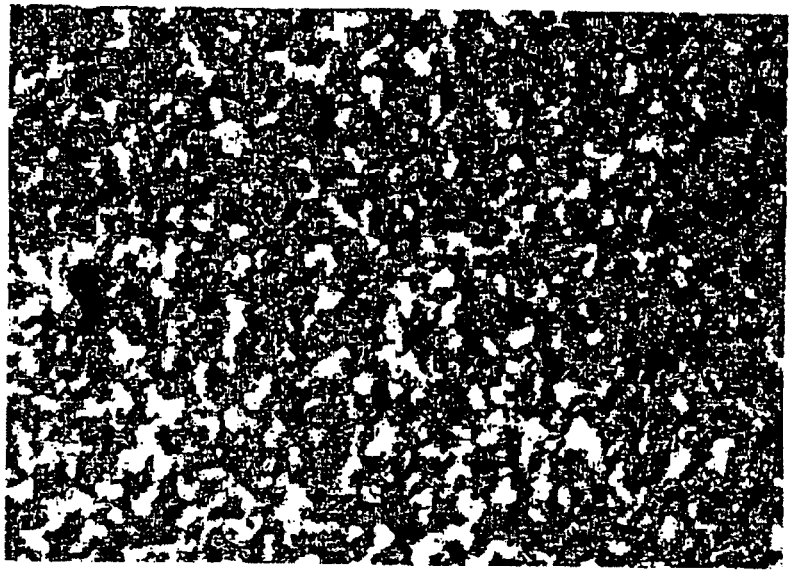
FIG. 9A is an SEM image of a cobalt tungsten phosphorus Co(W,P) layer deposited from a bath composition substantially devoid of alkali metal ions on a palladium-activated silicon substrate, at a resolution of 10,000, in accordance with a preferred embodiment of the present invention.
Figure 9B:
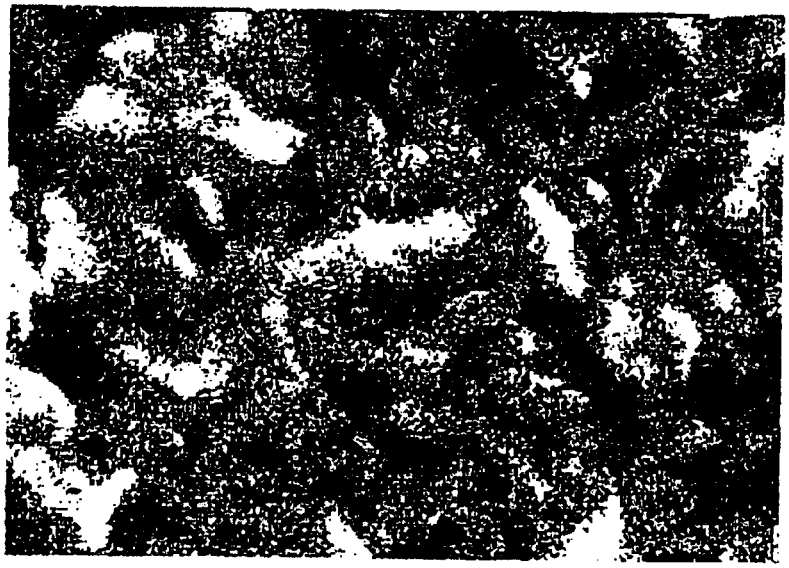
FIG. 9B is an SEM image of a cobalt tungsten phosphorus Co(W,P) layer deposited from a bath composition substantially devoid of alkali metal ions, on a palladium-activated silicon substrate, at a resolution of 50,000, in accordance with a preferred embodiment of the present invention.

Reference is now made to FIG. 9A, which is an SEM image of a cobalt tungsten phosphorus Co(W,P) layer deposited from a bath composition substantially devoid of alkali metal ions on a palladium-activated silicon substrate, at a resolution of 10,000. FIG. 9B depicts the same layer at a resolution of 50,000.

Figure 10:
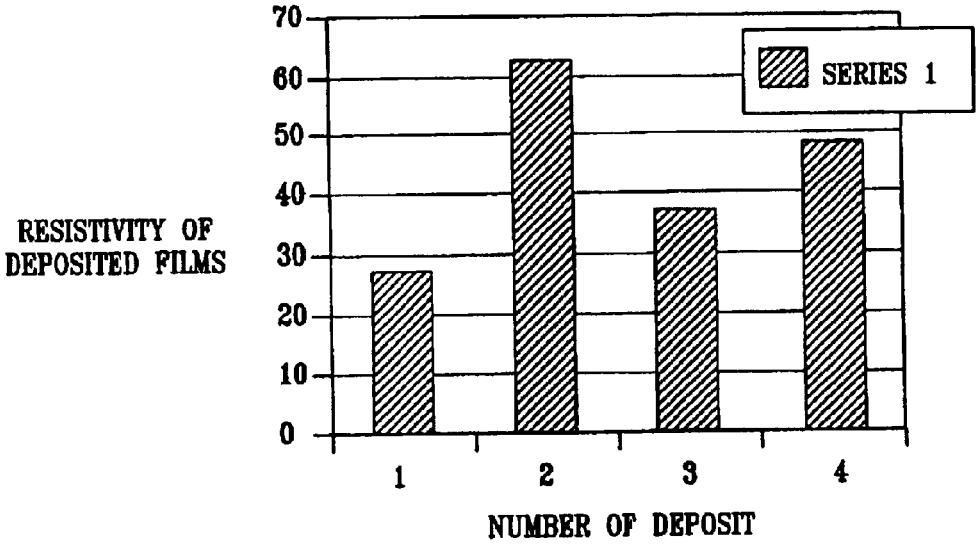
FIG. 10 is a diagram showing the resistivity of a cobalt and cobalt phosphorus thin films, in accordance with preferred embodiments of the present invention.

FIGS. 8A–8B, 9A–9B illustrate surface SEM images of Co(W,P) films obtained on Co-seed and Si-substrate with different resolution of 10000 and 50000. From the presented comparative data it may be observed that the surface morphology of the underlayer has a profound effect on the structure of the deposited layers thereupon. Thin electroless deposited films substantially copy the morphology of the underlayers. FIG. 10 is a diagram showing the resistivity of various cobalt thin films of 1) a film of 2200 Å deposited by sputtering; 2) the resistivity of a cobalt-phosphorus thin film of 2200 Å thickness deposited by electroless deposition on a cobalt seed, from a bath composition substantially devoid of alkali metal ions; 3) the resistivity of a film of cobalt tungsten phosphorus from a bath composition substantially devoid of alkali metal ions; and 4) the resistivity of a film of cobalt tungsten phosphorus from a bath composition deposited from a prior art alkali metal bath composition on a cobalt seed.

Resistivity and average resistance of the obtained films were measured by an In-Line Four Point Probe. FIG. 10 shows an effect of concentration ratio [W-ions]/[$Co^{++}$] in the bath on the resistivity of electrolessly deposited Co(P,W) films. FIG. 10 demonstrates the resistivity for a sputtered cobalt film, an electrolessly deposited Co(P) layer and electrolessly deposited Co(P,W) films.

It can be seen from FIG. 10 that when doping a cobalt film with the codeposited phosphorus (to produce an amorphous film), its specific resistivity increases. Conversely, resistivity of the film decreases as the tungsten concentration in the deposited layer increases. The resistivity of sputtered Co-film is 28 $\mu\Omega\cdot$cm, the resistivity of electroless deposited Co(P) films is 63 $\mu\Omega\cdot$cm and the resistivity of electroless Co(W,P) films deposited from the alkali metal ion free solution is 37 $\mu\Omega\cdot$cm.

EXAMPLE 1

Deposition on a palladium-activated silicon substrate.

Substrates were prepared comprising 1 $cm^2$ squares cut off from single crystal silicon substrate of 100 $cm^2$ (4 inch square). The silicon was of the p-type (i.e., doped with a group 3 element, such as boron) and typically had a sheet resistivity of 10 $\Omega\cdot$cm.

Reference is now made to FIG. 11, which is a simplified flow chart of a typical production process for the electroless deposition of cobalt tungsten phosphorus, including an activation stage.

Silicon wafers were activated by the process exemplified by FIG. 11 prior to electroless deposition. In a degreasing step 100, one or more substrates was immersed in a hot (70–90° C.) solution of ammonium hydroxide:hydrogen peroxide ($NH_4OH$:$H_2O_2$:DI water (1:1:5) by vol.) for several minutes up to an hour to remove organic residues. The substrate was rinsed thereafter in a rinsing stage 110.

In a metal oxide etch stage 120, the substrate was dipped for a few seconds in a hot (70–90° C.) hydrochloric acid:hydrogen peroxide solution (HCl:$H_2O_2$:DI water (1:1:6) by vol.). In this stage 120, metallic oxides were substantially removed from the silicon surface. Typically, the substrate was immersed in one or more rinse stages 130, to remove any residuals.

Thereafter, the substrate was immersed in a silicon oxide etch stage 140 for two minutes at room temperature. Typically stage 140 comprised a buffered oxide etch solution. For example, comprising 48% hydrofluoric acid (HF):40% ammonium fluoride ($NH_4F$) diluted tenfold in deionized water. This etchant typically effected removal of any native silicon dioxide. This stage 140 also served to improve the surface morphology of the substate. Thereafter, the substrate was rinsed again, typically in a deionized water cascade (not shown).

In an activation stage 150, the substrate was activated in a conventional palladium activation solution, as is known in the art, for several minutes. The conventional palladium activation solution comprised, for example, 5 ml/l $PdCl_2$ and 200 ml/l HF (48%).

In an optional rinse stage (not shown), the substrate was rinsed in DI water. Thereafter, the substrate was submerged in electroless deposition stage 160, such as in a small batch bath of Co-4M solution (Table 1 hereinabove) at 85–95° C. for 12 minutes.

The substrate was rinsed in deionized water in a rinse stage 170, and then dried in drying stage 180. The drying process typically involved dipping the substrate in a solvent, holding the substrate in gaseous stream and heating the substate in an oven, for example.

The deposition rate and the thin film composition were characterized as a function of the solution composition and bath conditions. Conventional material science techniques known in the art, such as Scanning Electron Microscopy (SEM) and various Scanning Probe Microscopy (SPM) techniques characterized the thin film morphology.

The CoWP films were analyzed by X-Ray Photoemission Spectroscopy (XPS) and Auger Electron Spectroscopy (AES) in a Physical Electronics PHI model 590A tool and Scanning electron microscopy (SEM) with a JEOL model JSM 6300 unit. The sheet resistance and resistivity of the films were measured by In-Line Four Point Probe method and the thickness was determined by a Tencor-"Alpha-step 500" profilometer. The topography and average height profiles were obtained from atomic-force-microscope (AFM) (Auto Probe CP, Park Scientific Instrument) measurements. All these reported measurements were carried out at room temperature.

A typical CoWP deposition profile on palladium-activated silicon is shown in FIG. 2 (empty squares) hereinabove.

On the industrial scale deposition stage 160 could be a standard electroless batch deposition system, or could be a tubular batch reactor or continuously stirred tank reactor, for example. The substrate may typically be held stationary, or may be agitated to enhance removal of gases (typically hydrogen) from the substrate surface.

EXAMPLE 2

Deposition on a copper and cobalt seed layers on silicon dioxide on a silicon substrate.

Silicon substrates (as in example 1) were covered with 100 nm thick thermally grown $SiO_2$ by methods known in the art. Thereafter a multi-layered metallic seed was deposited on the silicon dioxide. Two seed layer systems were studied. In the first system 10 nm of titanium was sputtered onto the silicon dioxide, 10 nm of copper was sputtered onto the titanium. Thereafter 10 nm aluminum was sputtered onto the copper. In a second system the 10 nm of copper was replaced with 10 nm of cobalt. The layers were deposited by ion-beam-sputtering using three targets in the same chamber. The system back-pressure was $<10^{-7}$ Torr prior to deposition and $\sim 2\times10^{-7}$ Torr during deposition.

Reference is now made to FIG. 12, which is a simplified flow chart of a typical production process for the electroless deposition of cobalt tungsten phosphorus, excluding an activation stage.

Substrates comprising sputtered metallic layers were dipped in a metallic etch stage 200. For example, the aluminum layer was used as a protective layer and was etched in etch stage 200 (FIG. 12). Stage 200 typically comprised a strong alkaline solution, such as 25% tetramethylammonium hydroxide. The substrate was optionally rinsed in a rinse stage 200, comprising deionized water. Thus a clean seed layer (either of copper or of cobalt) was exposed and the sample was immediately immersed in an electroless deposition stage 220 comprising composition Co-4M (Table 1). Deposition stage 220 was substantially similar to deposition stage 160 (FIG. 11). Various methods were employed to initiate immediate electroless deposition onto the substrate. For example, an aluminum wire was inserted into the solution, touched the seed layer. The wire was removed once the deposition process was activated.

Additionally or alternatively, an activation stage may be introduced to FIG. 12 prior to the electroless deposition stage.

Typically, the substrate is dipped in a heated activator (50–80° C.) (accelerator) comprising a reducing agent, complexing agent, additives and deionized water. Dipping a substrate into such an activator primes the surface of the substrate with the reducing agent and/or complexing agent, which, in turn leads to high initial electroless deposition in stages 160 and 220 respectively. The activator also serves to heat the substrate.

Following the electroless deposition stage, the substrate is rinsed in deionized water in a rinse stage 230, and dried in a drying stage 240. Stages 230 and 240 are typically substantially similar to stages 170 and 180 (FIG. 11) respectively.

Cobalt-tungsten-phosphorous thin films deposited by electroless deposition methods are widely employed, such as in magnetic, protective and special functional coatings. Conventional bath compositions for electroless Co(W,P) deposition usually consisted of precursors that contained alkali-ion metals like Na or K.

In contrast, the newly developed bath compositions of the present invention, wherein alkali metal ions have been eliminated, have several distinguishing features. These features are referred to both kinetics of deposition process and to the properties of obtained coatings.

In the prior art, baths for the electroless Co(P) deposition with the buffering system employing a base of ammonium sulfate and a caustic NaOH, KOH or ammonia, usually work at the pH value in the range of 9.5–10. It was found, that when the third alloying element, especially transition metal, is introduced in the system, the working pH value had to be increased up to the range of 10.5. Another issue was the deposition temperature. It was revealed that in order to get good quality deposit and ensure co-deposition of W, the temperature at the beginning of the process should be in the range of 90–95° C.

Furthermore, the composition of the Co(W,P) obtained from conventional baths (prior art) is characterized in that there is competition between tungsten and phosphorus content. Thus, the cobalt content in the deposit is approximately constant, whereas varying the concentration of a tungsten precursor in solution affects both the concentrations of the deposited tungsten and phosphorus. Furthermore, coatings obtained from prior art bath compositions, according to the XPS results, contain oxygen that may influence on the conductivity of the films.

In contrasts deposited metals from the bath compositions of the present invention do not contain oxygen (see Table 3). Moreover, they are characterized by the nearly constant phosphorus content. Changing the concentration of tungsten precursor in the bath composition, resulted in deposits with different content of W and Co (see Table 3). This effect may be a result of a different mechanism (which has not yet been fully elucidated) of tungsten inclusion in the solid matrix for the alkali metal ion free bath composition in comparison with the conventional bath compositions of the prior art.

The resistivity of the Co(W,P) thin films obtained from the newly developed bath composition was found to be generally lower rather than for those obtained from usual baths (see FIG. 10). The resistivity is known to be affected by contamination, for example residual oxygen. The oxygen concentration in the solid for both alkali metal ion compostions (prior art) and alkali metal ion free compositions is below the detection level of the AES system which is about 0.1%. It is therefore unknown if the improved resistivity is due to lower oxygen concentration.

It is envisaged that the bath compositions of the present invention may find wide employment in many industries, as well as research institutions. These industries include, but are not limited to semiconductor, microelectronics, silver-plate, jewelry, electro-finishing, aeronautic, space and motor industries. Products which may incorporate cobalt tungsten phosphorus and cobalt phosphorus deposited from the bath compositions of the present invention include, for example, semiconductor chips, ULSI and VLSI products, jewelry, nuts and bolts, magnetic materials, airplane wings, advanced materials and car parts.

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art, which would occur to persons skilled in the art upon reading the foregoing description.

What is claimed is:

1. An aqueous bath composition for the electroless deposition of cobalt tungsten phosphorus, comprising:

cobalt chloride hexahydrate ($CoCl_2.6H_2O$);

a soluble source of tungsten ions selected from tungsten trioxide ($WO_3$) and tungsten-phosphoric acid ($H_3[P(W_3O_{10})]_4$); and a reducing agent comprising phosphorus, wherein said composition is substantially devoid of alkali metal ions and alkaline earth metal ions.

2. A composition according to claim 1, wherein the cobalt chloride hexahydrate ($CoCl_2.6H_2O$) is present at a concentration of 10–40 g/l.

3. A composition according to claim 1, wherein said tungsten-phosphoric acid ($H_3[P(W_3O_{10})]_4$) is present at a concentration of less than 60 g/l.

4. A composition according to claim 1, wherein the reducing agent is selected from ammonium hypophosphoric acid ($NH_4H_2PO_2$) and hypophosphoric acid ($H_3PO_2$).

5. A composition according to claim 4, wherein said ammonium hypophosphoric acid ($NH_4H_2PO_2$) is present at a concentration of 10–30 g/l.

6. A composition according to claim 5, wherein said ammonium hypophosphoric acid ($NH_4H_2PO_2$) is present at a concentration of 12–25 g/l.

7. A composition according to claim 6, wherein said ammonium hypophosphoric acid ($NH_4H_2PO_2$) is present at a concentration of 15–20 g/l.

8. A composition according to claim 1, further comprising a complexing agent.

9. A composition according to claim 8, wherein said complexing agent comprises triammonium citrate ($[NH_4]_3C_6H_4O_7$).

10. A composition according to claim 9, wherein said triammonium citrate is present at a concentration of 40–60 g/l.

11. A composition according to claim 1, further comprising a surfactant.

12. An aqueous bath composition for the electroless deposition of cobalt tungsten phosphorus, comprising:

a soluble source of cobalt ions;

tungsten trioxide ($WO_3$); and a reducing agent comprising phosphorus, wherein said composition is substantially devoid of alkali metal ions and alkaline earth metal ions.

13. A composition according to claim 12, wherein said tungsten trioxide ($WO_3$) is present at a concentration of less than 7 g/l.

14. A composition according to claim 12, wherein the reducing agent is selected from ammonium hypophosphoric acid ($NH_4H_2PO_2$) and hypophosphoric acid ($H_3PO_2$).

15. A composition according to claim 14, wherein said ammonium hypophosphoric acid ($NH_4H_2PO_2$) is present at a concentration of 10–30 g/l.

16. A composition according to claim 15, wherein said ammonium hypophosphoric acid ($NH_4H_2PO_2$) is present at a concentration of 12–25 g/l.

17. A composition according to claim 16, wherein said ammonium hypophosphoric acid ($NH_4H_2PO_2$) is present at a concentration of 15–20 g/l.

18. A composition according to claim 12, further comprising a complexing agent.

19. A composition according to claim 18, wherein said complexing agent comprises triammonium citrate ($[NH_4]_3C_6H_4O_7$).

20. A composition according to claim 19, wherein said triammonium citrate is present at a concentration of 40–60 g/l.

21. A composition according to claim 12, further comprising a surfactant.

* * * * *